US005383122A

United States Patent [19]

Ohaeri

[11] Patent Number: 5,383,122

[45] Date of Patent: Jan. 17, 1995

[54] METHOD FOR ANALYZING PRESSURE BUILDUP IN LOW PUMPING RATE WELLS

[75] Inventor: Charles U. Ohaeri, Anaheim, Calif.

[73] Assignee: Union Oil Company of California, Los Angeles, Calif.

[21] Appl. No.: 906,893

[22] Filed: Jun. 30, 1992

[51] Int. Cl.[6] ..... G06G 7/57

[52] U.S. Cl. ..... 364/422; 73/155; 324/324

[58] Field of Search ..... 364/420, 422; 73/155; 324/323, 324

[56] References Cited

U.S. PATENT DOCUMENTS 4,123,937 11/1978 Alexander ..... 73/155
4,318,298 3/1982 Godbey et al. ..... 73/155
4,391,135 7/1983 Godbey et al. ..... 73/155
4,903,207 2/1990 Alger et al. ..... 364/422

*Primary Examiner*—Gail O. Hayes

*Assistant Examiner*—J. L. Hazard

*Attorney, Agent, or Firm*—Charles L. Hartman; William O. Jacobson; Gregory F. Wirzbicki

[57] ABSTRACT

The pressure build-up of hydrocarbon wells is quickly measured allowing the well to be shut-in for a shorter length of time than previously possible to achieve the same results. After the well has been shut-in at the surface the rate of change of the level of the gas/liquid interface within the well bore is determined. The level change data are converted into pressure build-up data and flow rate data. Applying the convolution integral to the pressure build-up data gives the value of the equilibrated pressure of the well. The deconvoluted data can then be used to solve conventional algorithms to determine the state of the well bore and surrounding formation. The operator of the well can then make a variety of decisions, including continuing to produce from the well, stimulating the well, or abandoning the well.

16 Claims, 8 Drawing Sheets

METHOD FOR ANALYZING PRESSURE BUILDUP IN LOW PUMPING RATE WELLS

BACKGROUND OF THE INVENTION

1. Field of the Invention

This invention relates to methods of analysis of the production rates and pressures of hydrocarbons from wells, particularly to automated calculation of the formation properties adjacent to the liquid hydrocarbon producing wells.

2. State of the Art

One can determine formation properties near a wellbore and general information about the condition of the wellbore in a liquid hydrocarbon producing well. Pressure transient techniques, the preferred methods for such determinations, measure how pressure in the well bore changes with time. In a commonly used pressure transient technique, the pressure build-up test, the operator shuts the well in and measures pressure recovery as a function of time.

The properties of the well can be determined using the pressure build-up test by shutting the well in and measuring its pressure recovery as a function of time. Ideally, the operator reworks the well down-hole to shut the well in at the top of the producing formation, a procedure hereinafter referred to as "down-hole shut-in." Although this approach would provide quick and accurate results, it requires expensive reworking the well down-hole. Therefore, economics normally dictates the practice of shutting the well in at the surface, herein after "surface shut-in." However, once the operator shuts the well in at the surface, fluid continues to flow from the producing formation into the well past the level of the top of the formation resulting in long test times. The flow, or "afterflow," as it is conventionally called, flows into the well bore and past the top of the formation distorting and prolonging the test. Eventually, the shut-in pressure recovers to the value that would have been recorded in a down-hole shut-in test. Such pressure equalization can take a long time, possibly over 100 hours. Once the pressure build-up data have been obtained, several different kinds of information about the well bore and the formation adjacent the wellbore can be determined, for example, a) formation pressure, b) formation permeability, and c) the well bore condition or damage, called "skin."

Pressure build-up tests are particularly beneficial for analyzing the reasons for the flow rate decline of a slow flowing well. Declines can occur for a variety of reasons, including plugging the perforations in the casing of the well, precipitation of scale in the formation immediately around the well bore, and exhaustion of the amount of hydrocarbon present in the formation. If the reason for the slow flow rate is formation damage, one may stimulate the well by fracturing or by pumping acid into the formation. However, if the reason slow flow is exhaustion of the resource, one may simply choose to abandon the well. Therefore, the operator of a slow flowing well needs to know the reason a well flows slowly. Unfortunately, oil production economics dictate that a slow flowing well may never return the cost of a down-hole shut-in, nor can the operator afford the loss of production that a surface shut-in requires. Consequently, operators only reluctantly test the wells that could benefit the most from the analysis.

Economics aside, there are problems with analyzing data obtained from slow flowing wells. In theory, the early part of a pressure build-up test contains important information concerning the well and the formation. However, in practice, the early data are noisy due to the wellbore afterflow. The early data are more sensitive to inconsequential impediments in the well perforations and the well bore.

Slow flowing wells may flow slowly for several reasons. Corrective action can be taken once the reason for the slow flow is known, but the time and loss of production involved in pressure build-up testing makes operators reluctant to test these wells. The operators of slow flowing wells need a quick pressure build-up test. Such a test would be able to use the early data obtained before pressure equilibration, thereby providing a short, accurate pressure build-up test.

SUMMARY OF THE INVENTION

This invention provides a quick method to test the pressure build-up of hydrocarbon wells. The rate of production of liquid hydrocarbon is determined by first determining the rate of change of the level of the gas/-liquid interface within the well bore. The data are converted into pressure build-up data and rate flow data. The pressure build-up data are then deconvolved to give the value of the equilibrated pressure of the well. The deconvoluted data can then be analyzed using conventional algorithms to determine the state of the well bore and surrounding formation. The operator of the well can then make a variety of decisions, including continuing to produce from the well, stimulating the well, or abandoning the well.

This method allows use of very early data, preferably data obtained within the first fifty hours of shut-in, to determine the state of the well. The well is shut-in at the surface, and the level of the gas/liquid interface is measured. The flow rate is determined from the data, and the convolution integral is solved by a numerical Laplace transform method. The data are then transformed back to real space and analyzed using conventional techniques. Depending on the result, the well is stimulated, or shut-in.

BRIEF DESCRIPTION OF THE DRAWINGS

FIG. 3 shows a graphical representation of the pressure within the formation versus the distance from the well bore at two different times: the time of shut-in, and some time after shut-in.

DETAILED DESCRIPTION OF THE INVENTION

Many hydrocarbon wells are "slow flowing" producing less than 100 standard barrels per day gross of oil plus water. Slow flowing wells are contrasted to fast flowing wells that frequently have sufficient pressure to push the hydrocarbon to the surface and out of the well. Fast flowing wells, unlike slow flowing wells, can easily be tested quickly by the well pressure build-up method because they fill rapidly and reach equilibrium promptly.

The formation properties and well condition for slow flowing wells are determined by using the pressure build-up method. This method of analysis uses the calculated pressure build-up within the well and calculated flow of hydrocarbon from the formation into the well to determine these properties. Two physical properties are measured versus time. The first, gas pressure within the well bore as measured at the surface, is measured as a function of time. The second is the change in the level of the gas/liquid interface, also measured as a function of time. The data obtained in the process of the invention is typically quite noisy, but the invention allows the use of noisy data. Information about the formation around the wellbore and the condition of the wellbore can be calculated from these two measured time dependent variables.

It is best seen how the condition of the well can be calculated when the measured quantities are displayed as a series of graphical representations. Several ways exist to graphically depict the relationships between flow (q), pressure (p), time (t), and distance from the well bore in the formation (r). In a pressure build-up test, one measures how the level of liquid hydrocarbon within the well bore varies with time, and then calculates pressure and flow rates from the knowledge of the level. Many of the numbers used for determining the mathematical equations depicted require extrapolations based on the production history of the well and knowledge of the formation. In the following graphical representations the variables have the same labels. Any quantity referred to in one drawing will have the same label in all drawings. Similarly, a line, a feature or a variable labeled the same in any two or more drawings or equations refers to the same thing in each drawing or equation.

Figure 1:
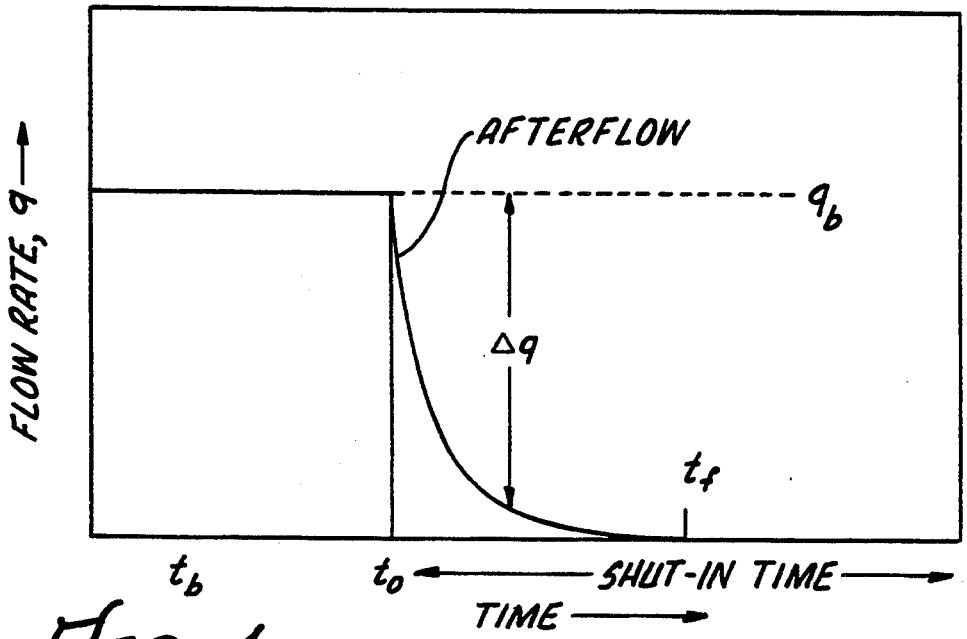
FIG. 1 shows a graphical representation of the flow of liquid in a well bore versus time before shut-in at the surface and after shut-in at the surface.

Referring now to FIG. 1, the flow rate (q, the vertical axis) is measured versus time (t, the horizontal axis). The flow rate is fairly constant ($q_b$) before surface shut-in and slowly drops to 0 as the flow stops after shut-in at time $t_f$. During production, that period of time ($t_b$) before the time of shut-in ($t_0$), the hydrocarbon flows at $q_b$. After $t_0$, when the well is shut-in at the surface, the flow does not stop abruptly, but instead drops off slowly due to the afterflow effect. Finally, at $t_f$ the afterflow essentially stops, and the pressure down-hole equilibrates with the formation pressure.

Figure 2:
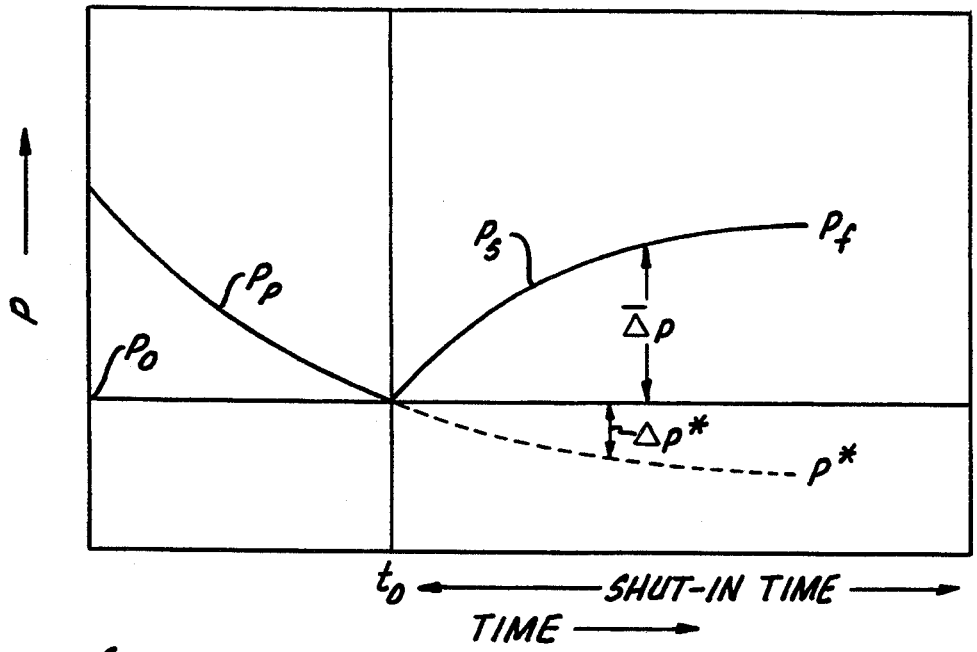
FIG. 2 shows a graphical representation of the pressure recorded in a well plotted versus time before and after shut-in at the surface.

Referring to FIG. 2, a pressure (p, the vertical axis) response shown corresponds to the flow rate of FIG. 1. The pre-shut-in production pressure response ($p_p$) declines before $t_0$ when plotted against time (t, the horizontal axis). $p_p$ constantly decreases with continued oil production from the well. Then at $t_0$ the well is shut in at the surface. At $t_0$ the pressure of the hydrocarbon being forced into the well bore is $p_0$. Immediately, the shut-in pressure measured in the well ($p_s$) starts to increase from $p_0$. An extrapolated production pressure ($p^*$) shows the best estimate of continued production based on knowledge of the formation and past production history. It can be seen that $p^*$ is the difference between $p_0$ and the extrapolated pressure curve of continued production. At $t_f$, $p_s$ equilibrates with the formation pressure ($p_f$) becoming essentially constant, or, equivalently, the change in pressure measured in the well ($\Delta p_s$) becomes 0.

Figure 3:
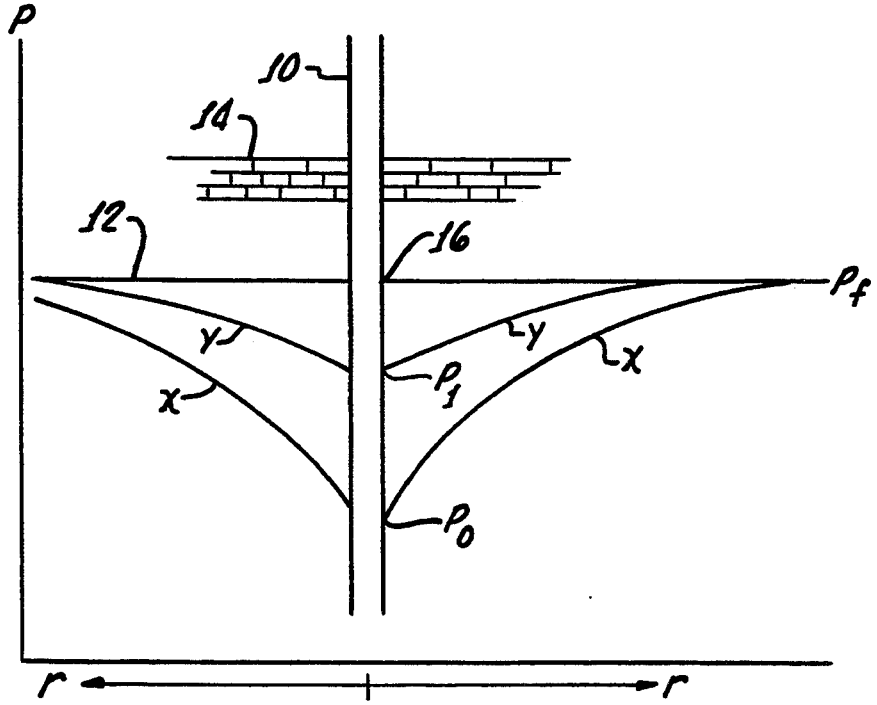

Referring to FIG. 3, a well bore 10 of a slow flowing well penetrates the top of a formation 14 where a reservoir 12 of liquid hydrocarbon is found. The pressure profile labeled X represents the pressure (p, represented by the vertical axis) of the hydrocarbon throughout the formation at increasing distance from the well bore (r, represented by the horizontal axis) at time $t_0$. The pressure within the formation ($p_f$) is independent of whether the well is shut in at the surface or the top of the formation. However, the pressure will equilibrate faster if the well is shut-in downhole at the down hole shut-in location 16 since no fluid has to flow into the wellbore to increase the pressure. Some time after $t_0$, at time $t_1$, the pressure throughout the formation has recovered somewhat because no liquid has been removed, as shown by the pressure profile Y. The pressure measured at the well bore is $p_1$. The pressure within the formation varies as shown by the pressure profile X as the pressure throughout the formation equilibrates to $p_f$. After reaching equilibrium, at $t_f$, the pressure through out this ideal formation is a constant value and is $p_f$.

Figure 4:
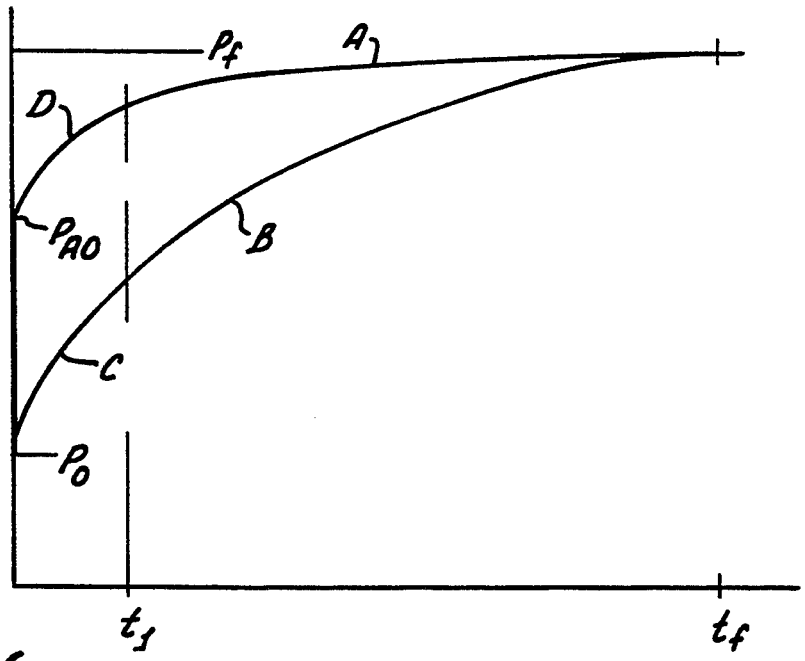
FIG. 4 shows a graphical representation of the pressure change versus time comparing a first well shut-in down hole and a second well shut-in at the surface.

Referring to FIG. 4, curve A and curve B represent the pressure recovery of two different, but generally similar, wells in the same formation. They are presented together, so the difference between the pressure response of the down-hole shut-in, the situation of curve A, and the pressure recovery of a similar well shut-in at the surface, the situation of curve B, can be compared. The key to the invention is understanding that the information shown in curve B can be changed by mathematical manipulations into the information of curve A. It should be understood that conventionally the information of curve B is analyzed by curve fitting. The mathematical analysis of the data provided by the invention shortens the test from perhaps two thousand hours to fifty, and provides more rigorous answers.

Curve A represents an idealized sandface pressure recovery curve obtained for well A that has been shut-in at the top of the producing formation. The pressure recovers from a minimum measured down-hole shut-in pressure ($p_{A0}$) and equilibrates with $p_f$ as time passes. Curve B represents the idealized pressure recovery curve for well B, a second well in the same formation, having the same final formation pressure $p_f$. Well B is shut-in at the surface; therefore, curve B is the same as the curve shown in FIG. 2 after $t_0$. The minimum measured shut-in pressure, $p_0$, for curve A starts off the same, but the pressure in well A very rapidly builds up to $p_{A0}$ because well A has no gas within the well bore to compress. The difference between $p_{A0}$ and $p_0$ is the oil that flows into the wellbore as a function of the afterflow effect. At the start of the test no oil has flowed into the wellbore, although later, as hydrocarbon flows into the well bore, the pressure increases. The pressure measured at time $t_1$ is $p_1$. Since the two curves substantially converge at a pressure of $p_f$ at time $t_f$, the well properties that can be measured from the down-hole shut-in test can be measured from the surface shut-in test at time $t_f$. In a usual pressure build-up test the operator must close the well, and wait, until time $t_r$. However, the invention allows calculation of the formation properties using the information gathered by time $t_1$.

If the well test is stopped at time $t_1$ instead of $t_f$ the curve segment D represents the data recovered from well A, a portion of the idealized sandface recovery curve A. Similarly, the curve segment C represents the data obtained from well B. Curve segment C corresponds to curve segment D. Since the pressure recovery behavior of wells is theoretically well understood, reservoir properties can be determined from the response of, for example, curve segment D. Currently used techniques do not allow the information in segment C to be transformed into curve segment D. In the method of the invention, the information contained in the curve segment C is mathematically manipulated to reveal the information contained in curve segment D. Since the data comprising segment C are all that is needed, the well need not be shut-in longer than $t_1$.

THE MATHEMATICAL MODEL USED

Before one can apply a mathematical solution to the problem of pressure build-up, and calculate curve segment D, one needs a mathematical model that accurately represents the physical processes happening in the formation during pressure recovery. Liquid hydrocarbons flow through most formations in radial flow. A partial differential equation called the diffusivity equation, Eq. (1), describes the flow of fluids in porus media:

$$\frac{1}{r}\frac{\partial}{\partial r}\left(r\frac{\partial p}{\partial r}\right)=\frac{1}{\eta}\frac{\partial p}{\partial t} \quad (1)$$

where:

r is the radial distance, p is the pressure, t is the time, $\eta$ is the hydraulic diffusivity, an intrinsic property of the formation rock.

The diffusivity equation is linear with respect to time. The superposition theorem can be applied to partial differential equations representing physical phenomenon that are linear with respect to time. Application of the superposition integral to data is also known as "deconvolution" of the data because the integral used in the application of the superposition theorem is the "convolution integral." Because the diffusivity equation is a partial differential equation that is linear with respect to time, the superposition theorem can be applied to calculate the solution to the diffusivity equation. However, application of the superposition theorem requires knowledge of the liquid flow rates versus time. Once the liquid hydrocarbon flow rates from the sandface are known, the superposition theorem allows calculation of the zero rate sandface buildup pressure.

Based on the model provided by the diffusivity equation, curve segment D can be calculated by a general procedure. Simultaneous pressure and rate measurements are calculated from pressure and fluid level data, after which the pressure and flow data are mathematically manipulated to provide the sought after data on the condition of the wellbore and adjacent formation. This mathematical manipulation involves four steps. First, the measured fluid level and surface pressures are converted to bottom hole pressures and afterflow rates. Second, the pressure and afterflow rate-changes are calculated from the results of the first step. Third, the pressure and afterflow rate changes are used to solve the convolution integral by transforming the convolution integral into Laplace space using the numerical Laplace transform algorithm. Fourth, the Laplace space solution is transformed back into real space using numerical inversion algorithms. For radial flow problems, Schaprey's approximate inversion formula is preferred.

OBTAINING PRESSURE AND AFTERFLOW RATES

The flow rate can be calculated from the data conventionally recorded during a pressure build-up test. In a typical test, an echometer mounted on the well generates the data on the level of the rising gas/liquid interface within the well bore. First, a valve is closed at the surface shutting the well-in. The echometer impresses a series of gas pressure wave fronts onto the rising gas/liquid interface within the well bore at known intervals of time. For each gas pressure wave front the changing level of the rising gas/liquid interface within the well bore is determined by the length of time required to detect the returning echo. The pressure created by the column of liquid hydrocarbon is directly related to the level of the gas/liquid interface.

The procedure to estimate sandface pressures and rates is relatively straightforward. One must account for the amount of hydrocarbon gas dissolved in the liquid phase during computation of liquid rates. Thus, for any two liquid levels, $h_1$ and $h_2$ measured at times $\Delta t_1$ and $\Delta t_2$, the expression for the liquid flow rate is given by Eq. (2):

$$q_L=\frac{-4.27A(h_2-h_1)C}{\Delta t_2-\Delta t_1} \quad (2)$$

Where:

q is the flow rate, in STB/D;

t is time, in hours;

A is the cross section area, in square feet; and

C is the effective oil fraction.

The gas flow rate is calculated by considering the volume of gas within the well bore pipe and/or casing at two different times. The gas flow rate is represented by Eq (3):

$$q_g = \frac{v_{2g} - v_{1g}}{\Delta t_2 - \Delta t_1} \quad (3)$$

where $v_g$ is the gas volume defined Eq. (4):

$$v_g = \frac{AT_{sc}}{p_{sc}} \int_{h_g}^{0} \frac{p}{zT} dh' \quad (4)$$

where A is the cross section in square feet,

T is temperature and p is pressure, $p_{sc}$ $T_{sc}$ is the standard temperature, 60° F., $P_{sc}$ is the standard pressure, 1 atmosphere, and Z is the gas deviation factor.

The shut-in bottom hole pressure is calculated from the relationship given in Eq. (5):

$$p_{ws} = p_C + \Delta p_{gC} + \gamma_o L \quad (5)$$

where:

$p_C$ is the casing pressure, in psia;

$\Delta p_{Cg}$ is the weight of the gas column psia;

$\gamma_o$ is the average liquid gradient, psia/ft; and

L is the height of the liquid column within the well bore, feet.

APPLYING THE SUPERPOSITION INTEGRAL

Once the flow rate inside the well bore is known, the superposition theorem can be applied to the liquid level data obtained from the well. The constant rate sandface pressure $\Delta p(t)$ is related to the measured pressure change, $\Delta p_w(t)$, by the general convolution integral Eq. (6):

$$\Delta p_w(t) = \int_0^t q(t)\Delta p'(t - \tau)d\tau \quad (6)$$

where $\Delta p_w$ is the measured well pressure change;

q=flow rate; and $\Delta p'$=time derivative of pressure change caused by constant sandface production; and t=time.

The correct convolution integral for pressure buildup analysis is:

$$\Delta p_w(\Delta t) + \Delta P^*(\Delta t) = \int_0^{\Delta t} \Delta q(\tau)\Delta p'(\Delta - \tau)d\tau \quad (7)$$

where $\Delta p'$ is the time derivative of the constant sandface pressure rise;

$\Delta p_w$ is the buildup pressure rise, or equivalently, $p_f - p_0$;

$\Delta p^*$=difference between pressure at shut-in, $p_{wf}$, and the extrapolated flowing pressure, p*.

$\Delta q$=the afterflow rate change, or equivalently $q(t+\Delta t) - q(t)$;

t is the flow time prior to shut-in; and $\Delta t$ is the shut-in time.

USING THE LAPLACE TRANSFORM

The convolution integral is best evaluated by using a Laplace transform approach to solving integrals. The Laplace transform allows one to transform an integral function in real space into a transformed algebraic equation in complex variable Laplace space. The transformed equation can then be solved by essentially algebraic manipulations. Equations are far more easily evaluated by algebraic manipulations than by integration. Using the Laplace transform, and rearranging the resulting expression, the zero sandface rate pressure solution in the Laplace space is given by Eq (8):

$$\overline{\Delta p}(s) = \frac{\overline{\Delta p_w(s) + \Delta p^*(s)}}{s\Delta q(s)} \quad (8)$$

where, s is the Laplace space variable; and $\Delta p(s)$ is the Laplace transform of f(s) is given by Eq (9):

$$f(s) = \int_0^{\infty} e^{-st}F(t)dt \quad (9)$$

Since solving Laplace transformations directly is computationally difficult, the most efficient way to solve the equation is by use of the numerical Laplace transform procedure. This involves solving a series of approximations for two dimensionless arrays of times and pressures and summing the individual members of the series, rather than rigorously solving the integral. The array is most conveniently solved by computer using the algorithm presented by Roumboutsos et al, SPE 18517, Oct. 1988, at the 63d annual Technical Conference and Exhibition in Houston, Tex. For time and pressure Tables $\{\Delta t_{D1}, \Delta t_{D2}, \ldots \Delta t_{Dn}\}$ and $\{\Delta p_{D1}, \Delta p_{D2}, \ldots \Delta p_{Dn}\}$ the numerical Laplace transform is then represented by Eq (10) given by:

$$\overline{\Delta p}(s) = \frac{1}{s^2}\left[\Delta p_1'(1 - e^{-s\Delta t_1}) + \sum_{i=2}^{i=n} \Delta p_i'(e^{-s\Delta t_i} - e^{-s\Delta t_{i-1}}) + \Delta p_n' e^{-s\Delta t_n}\right] \quad (10)$$

where $\Delta p'$ is represented by Eq. (11):

$$\Delta p' = \frac{\Delta p_i - \Delta p_{i-1}}{\Delta t_i - \Delta t_{i-1}} \quad (11)$$

To get the Laplace transform of the rate data, one replaces $\Delta p$ with $\Delta q$ in Eqs. (10) and (11).

CONVERTING THE ANSWER BACK INTO REAL SPACE

Once the data has been transformed into Laplace space, the answer needs to be transformed back into real space. One can use any of several algorithms for this purpose, for example, those of Stehfest, Schapery and Crump. Although the Crump algorithm is mathematically more rigorous, the algorithm takes a long time if the input are noisy data (hours on a fast computer) due to slow convergence. Since real data from producing wells are unavoidably noisy, another algorithm is generally preferred. However, the Stehfest algorithm, although computationally fast, tends to produces oscillations for noisy data. Therefore, the preferred algorithm is Schapery's algorithm. The modified Schapery's approximate inversion formula is especially useful when the deconvolved pressures result in radial flow. In such cases, this algorithm is extremely fast, taking on the order of seconds to calculate, and is less affected by noise than the other methods. The relevant expression here is:

$$F(t) = L^{-1}f(s) = [sf(s)]_{s=\frac{1}{\gamma t}} \quad (12)$$

where $\Delta\bar{p}(s)$ is defined in Eq. 10

$\gamma$ is the exponential of Euler's constant ($\gamma=1.781$). This equation is valid if $\delta f(s)/\delta(\ln s)$ is a slowly varying function of the natural logarithm of s, which is true during radial flow.

The afterflow rates obtained from the data using echometer fluid level measurements were calculated. Although the echometer was used primarily due to cost considerations, one could not have used spinners (i.e., propellers placed in the rising column of liquid hydrocarbon), due to low flow rates of the liquid hydrocarbon. It should be appreciated that one need not use fluid level data for the deconvolution process in general. Any other method of obtaining pressures, flow rates, and the change in pressures and flow rates over time can be used.

SUMMARY OF THE METHOD USED

A general procedure to first obtain simultaneous pressure and rate measurements from fluid level data and, thereafter, deconvolve the afterflow dominated pressure buildup data involves four steps. First the measured fluid level and surface pressures are converted to bottom hole pressures and afterflow rates using Eqs. (2), (3), and (4). Second, the pressure and afterflow rate changes are calculated from the results of the first step. Third, the pressure and rate changes are transformed into the Laplace space using the numerical Laplace transform algorithm, Eqs. (10) and (11) and the constant rate (zero rate) pressure is calculated. Fourth, the Laplace space solution is transformed back into real space using numerical inversion algorithms. For radial flow problems, Schaprey's approximate inversion formula, Eq (12), is preferred.

The third Step in the process above is an iterative process because $\Delta p^*$ cannot be known until the reservoir model is identified. Computationally, one sets $\Delta p^*$ to zero initially and then uses the deconvolved pressures in the first pass to determine the reservoir model and therefore the extrapolation of $p_{wf}^*$ which yields $\Delta p^*$. However, if infinite acting radial flow is appropriate during the extrapolation period, then $\Delta p^*$ is given by Eq. (13):

$$\Delta p^* = m\log\left(\frac{t+\Delta t}{t}\right) \quad (13)$$

where m is the slope of the graph line resulting from plotting $\Delta p$ versus the logarithm of $\Delta t$ on semi-log paper.

It is necessary to smooth afterflow rate data obtained at times close to $t_0$, the time of well shut-in. Usually, except when the skin factor is high, or, equivalently, the condition of the wellbore is poor, the most rapid rate changes occur shortly after shut-in. The data obtained during this period tend to be noisy. The instantaneous flow rate at shut-in can then be determined. The value is usually not the same as the first reported flow rates, which are usually an average over 24 hours. It is important to smooth the early rate and have knowledge of the instantaneous rate at shut-in to successfully deconvolve the data.

Once the operator has obtained the deconvoluted data, he can analyze it by conventional algorithms, for example, used to analyze pressure build up data from shut-in wells. This analysis can tell the operator the state of the well bore and the surrounding formation. Depending on the results, the operator can stimulate the well, abandon the well or leave the well alone. The great advantage of this invention is it allows the operator to procure the data needed for a pressure build up analysis in much less time than currently used techniques.

EXAMPLES

Three buildup tests analyzed using the procedure of the invention demonstrate deconvolution to determine well and formation parameters from field pressure buildup data. The three wells involved, all in the Haas field North Dakota, are pumping wells, producing at flow rates of 100 STB/D or less. The durations of the buildups range from 142 to 432 hours. In all cases, no radial flow data are evident on the original pressure response. Table 1 summarizes the test and well parameters.

TABLE 1

Summary of Test and Well Parameters

| Parameter | Example 1 | Example 2 | Example 3 |
|---|---|---|---|
| Total Flow Time, $t_p$, hours | 500 | 1000 | 3767 |
| Starting Liquid Level, feet | 3999 | 3988 | 3991 |
| Ending Liquid Level, feet | 2790 | 2742 | 2386 |
| Total Shut-in time, hours | 281 | 431.9 | 142.5 |
| Instant Rate at Shut-in, STB/D | 10.52 | 12 | 26 |
| Total Mobility, $(k/\mu)_t$, md/cp | 5.44 | 0.576 | N/A |
| Permeability, k, md | — | — | 2.8 |
| Skin factor, s | −1.14 | N/A | −2.27 |
| Fracture half length, $x_f$, feet | N/A | 384 | N/A |

Example 1

Figure 5:
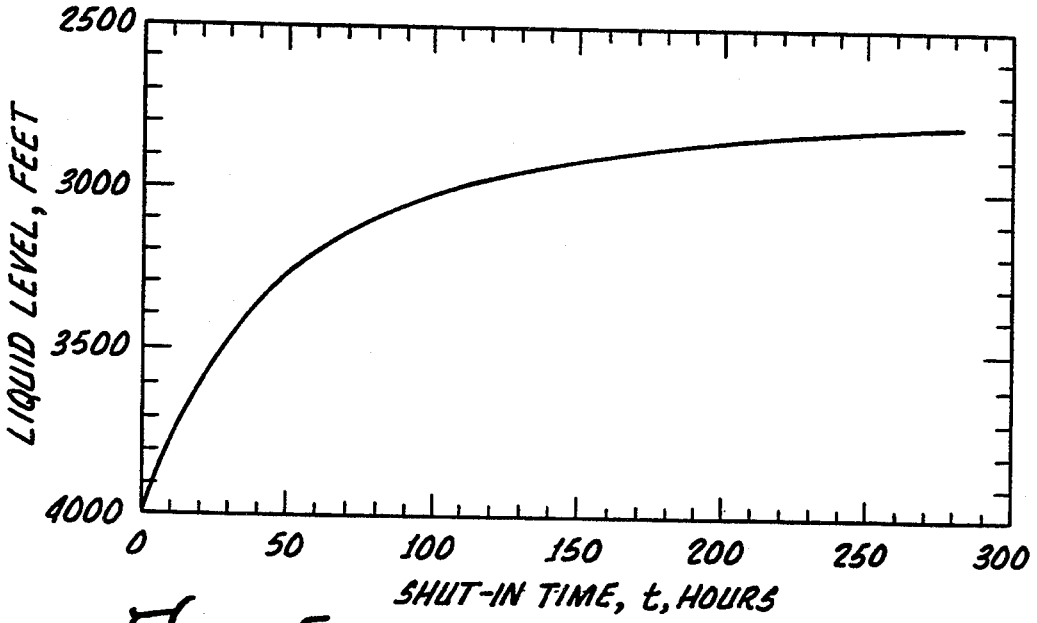
FIG. 5 shows a graphical representation of the level of the computed liquid/gas interface within the well bore versus time for Example 1.
Figure 6:
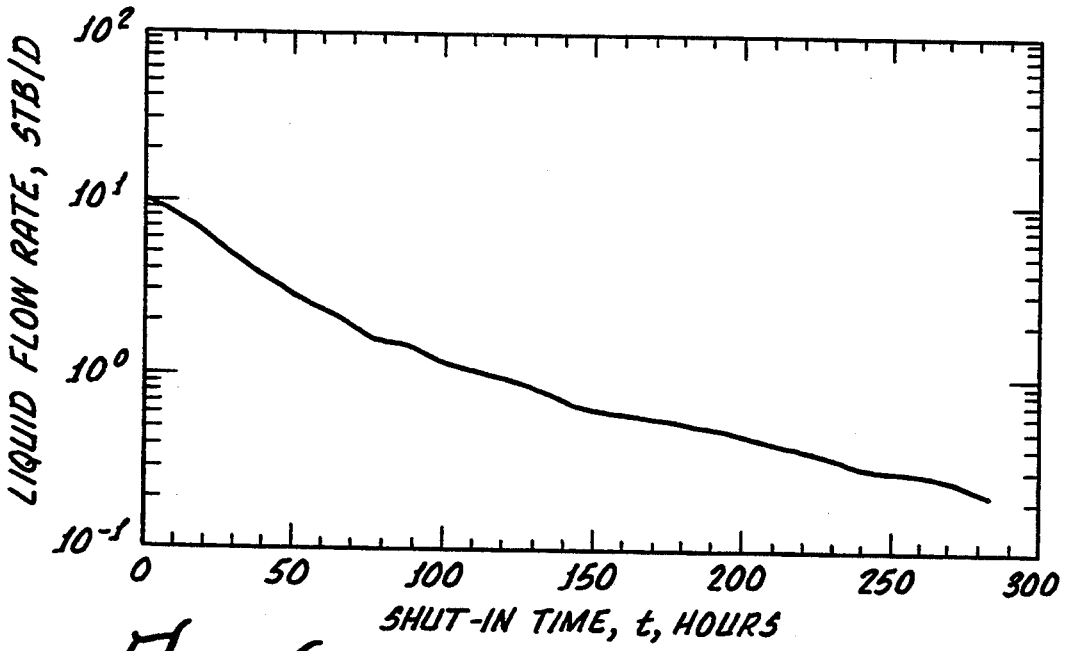
FIG. 6 shows a graphical representation of the liquid flow rate versus time for Example 1.

The well of this Example produced for about 500 hours before shut-in. The buildup test lasted 281 hours. The fluid level rose during shut-in from a depth of 3999 ft to 2790 feet during the test, as shown in FIG. 5. No special or unusual responses are evident on this graph. FIG. 6 is a graph of the logarithm of liquid afterflow rate versus the shut-in time. Note that the after flow rate is not smooth, nor does it decline exponentially with time. This rate data are reduced to pressure and time tables and Eq. (10) is applied.

Figure 7:
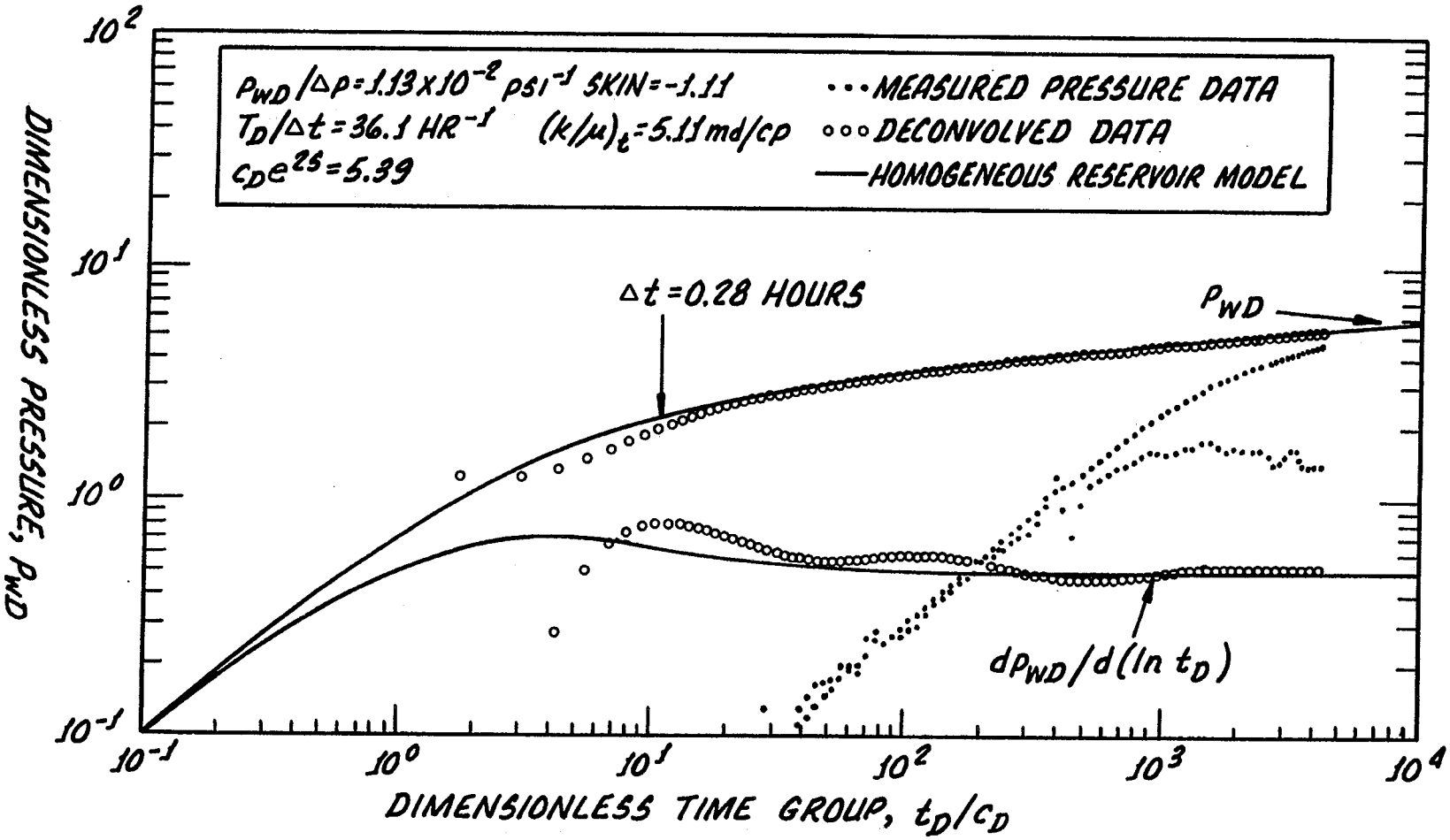
FIG. 7 shows a graphical representation of the log of pressure change versus the log of elapsed time for Example 1 showing the variation of the pressure and the variation of the derivative of the pressure curve in dimensionless parameters.

FIG. 7, presents a type curve analysis of the buildup pressure response. The graph shows both the measured and deconvolved pressure changes as well as their logarithmic derivatives, ($d\Delta p/d\ln \Delta t$). The small squares represent the measured data, and the large diamond shapes depict the deconvolved pressures. Furthermore, the solid lines represents the homogeneous reservoir type curves for $c_De^{2s}=5.39$.

In FIG. 7, one can see the effect of the deconvolution process in decreasing the effect of wellbore storage. The measured pressure data before deconvolution did not reach radial flow during the test and unique analysis of this data are difficult. This is evident on the pressure derivative. On the other hand, the deconvolved data exhibit about two and half cycles of radial flow. This test allows a reduction by a factor of 10 in the amount of time it takes to obtain a satisfactory analysis run. The calculated formation total mobility, $(k/u)t=5.44$ and the skin factor is $-1.14$. Thus, using the deconvolution process it is possible to obtain a complete analysis of the buildup test.

Example 2

Figure 8:
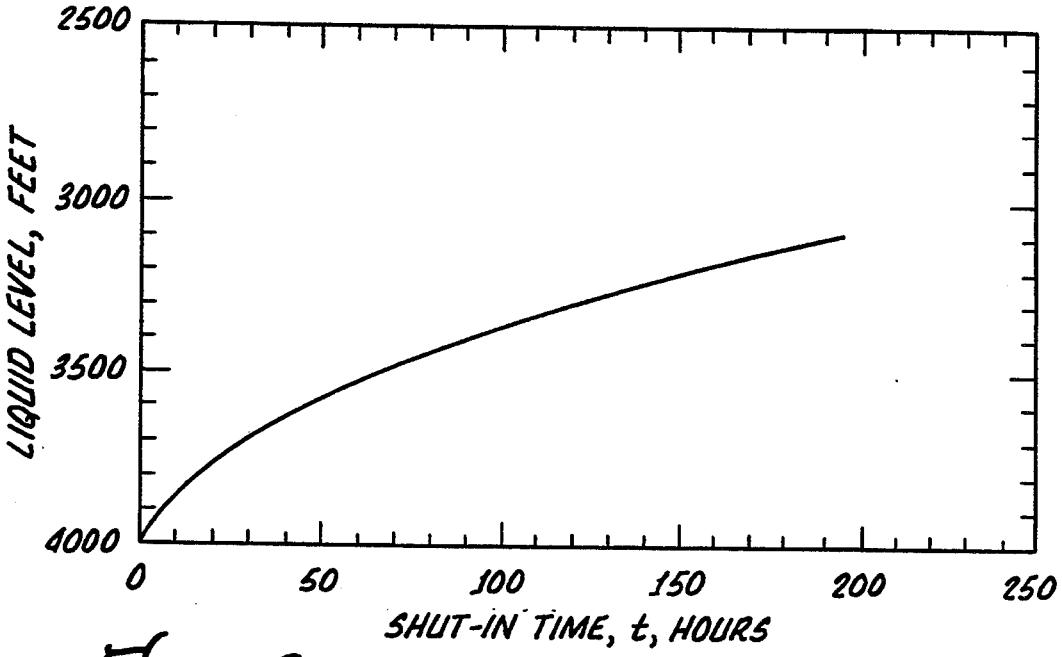
FIG. 8 shows a graphical representation of the level of the liquid/gas interface within the well bore versus time for Example 2.
Figure 9:
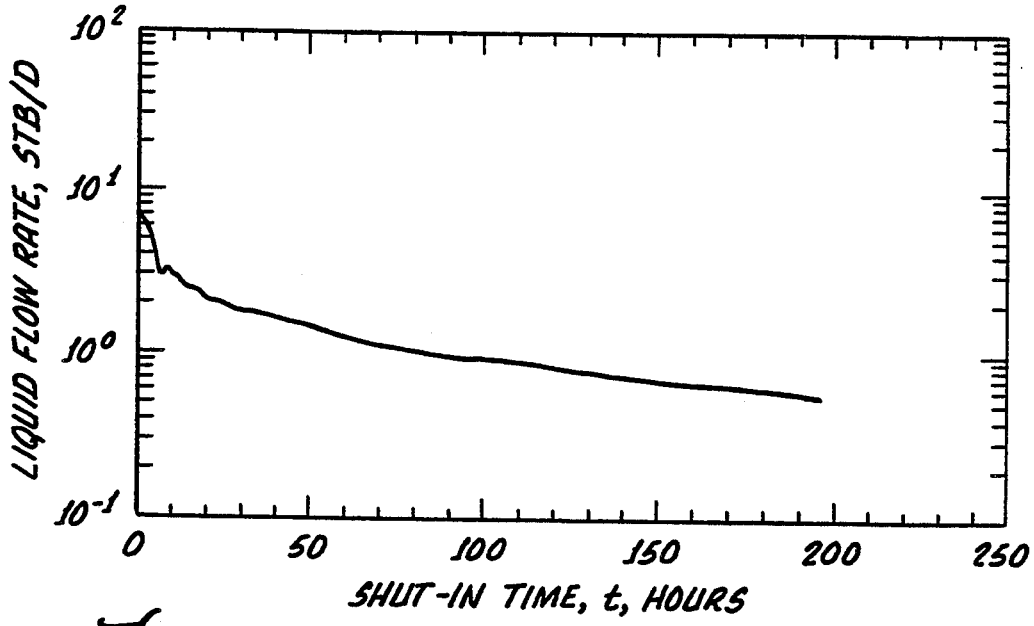
FIG. 9 shows a graphical representation of the computed liquid flow rate versus time for Example 2.

In the well of this Example, the duration of the flow period for this well is 1000 hours, and the pressure buildup lasted 431.9 hours. The gas/liquid interface rose from 3988 feet to 2742 feet depth during the shut-in period, as shown in FIG. 8. Referring to FIG. 9, a semi-log plot of the logarithm of computed afterflow rates during shut-in versus time shows that, after about the first 50 hours of uneven flow after shut-in, the flow rate smooths out and appears to decline exponentially with time.

Figure 10:
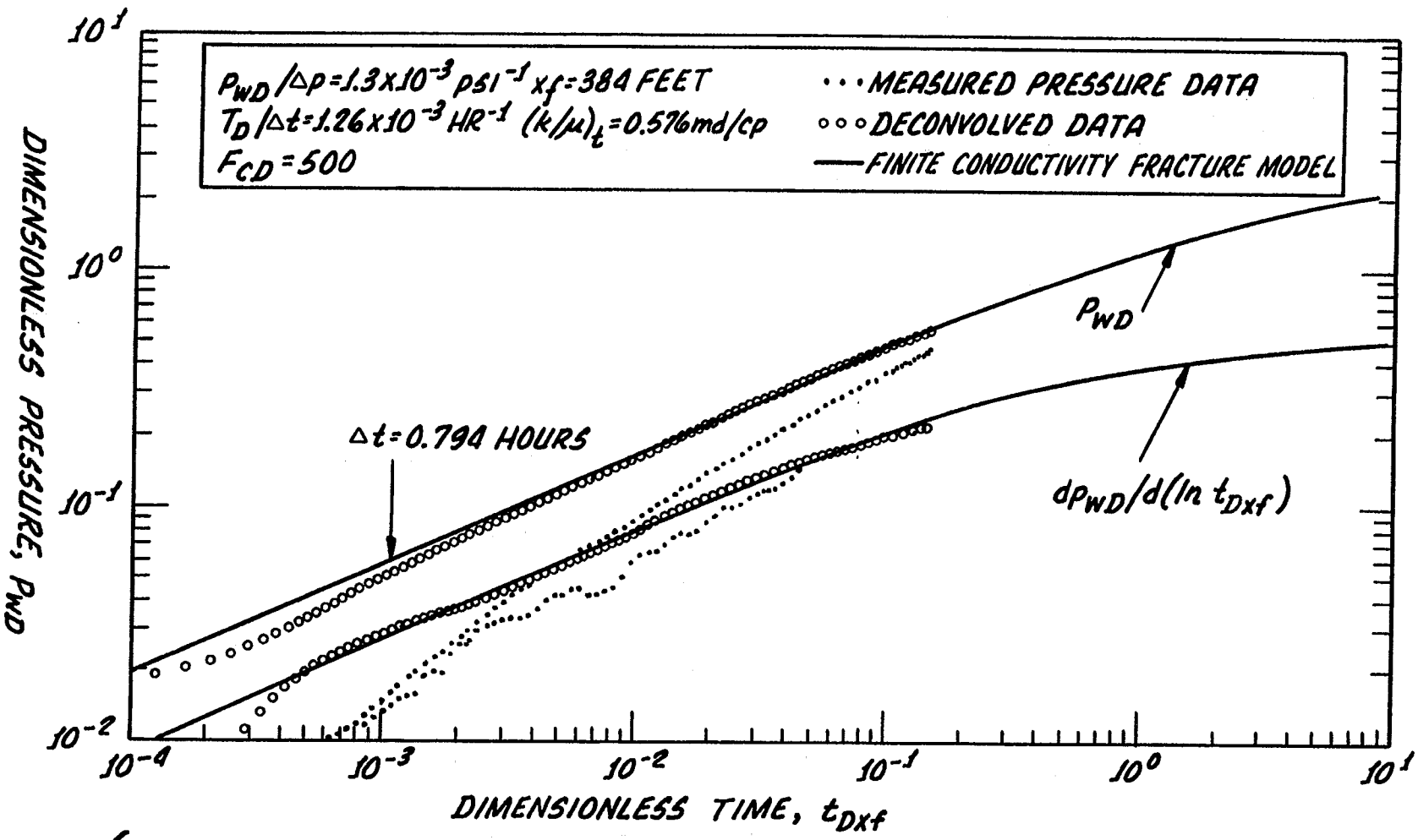
FIG. 10 shows a graphical representation of the log of pressure change versus the log of elapsed time for Example 2 showing the variation of the pressure and the variation of the derivative of the pressure curve in dimensionless parameters.

FIG. 10, the plot of the logarithm of pressure versus the logarithm of time, shows the type of curve typical of those obtained from a fractured well. This figure shows both the measured data using small squares and the deconvolved data using the large diamond shapes. The solid lines represent the theoretically known finite conductivity fractured well type curve and the fracture conductivity. The fracture conductivity for the well is 500. The graph also presents both the pressure responses and the logarithmic slope of the pressure response.

The results in FIG. 10 demonstrate the effect of deconvolution on the buildup data. Whereas the measured pressures show no fracture flow regime, the deconvolved pressures clearly exhibit this effect. This confirms the presence of a hydraulic fracture in this well. Furthermore, even though impossible to analyze directly, once deconvolved, the measured data provided information about the fracture. This illustrates the application of deconvolution in identifying early time flow regimes. The estimated total mobility $(k/u)_t$ is 0.576 md/cp, and the calculated fracture half length, $x_f$, is 384 feet.

Example 3

Figure 11:
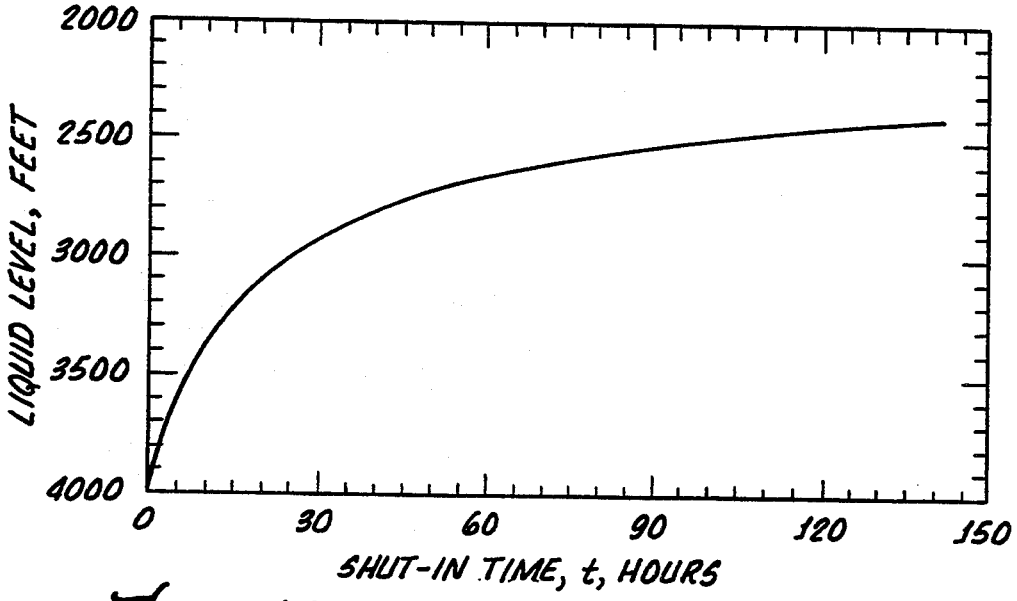
FIG. 11 shows a graphical representation of the level of the liquid/gas interface within the well bore versus time for Example 3.
Figure 12:
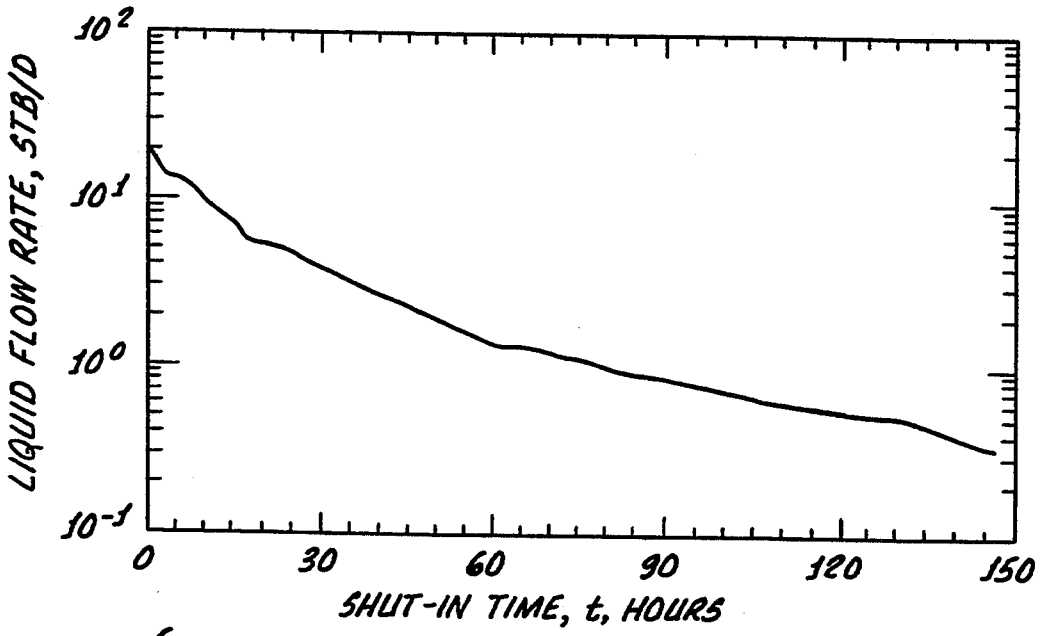
FIG. 12 shows a graphical representation of the computed liquid flow rate versus time for Example 3.

In this Example, the well produced for 3767 hours prior to shut-in. The shut-in period lasted for 142.5 hours, and the gas/liquid interface level rose from 3991 to 2386 feet during the buildup period. FIG. 11 shows the fluid level change with time. FIG. 12 shows a semi-logarithmic plot of the computed flow rates versus time. The afterflow rate here is noisy at times soon after shut-in. After about 60 hours of shut-in time, the flow rate appears to decline exponentially.

Figure 13:
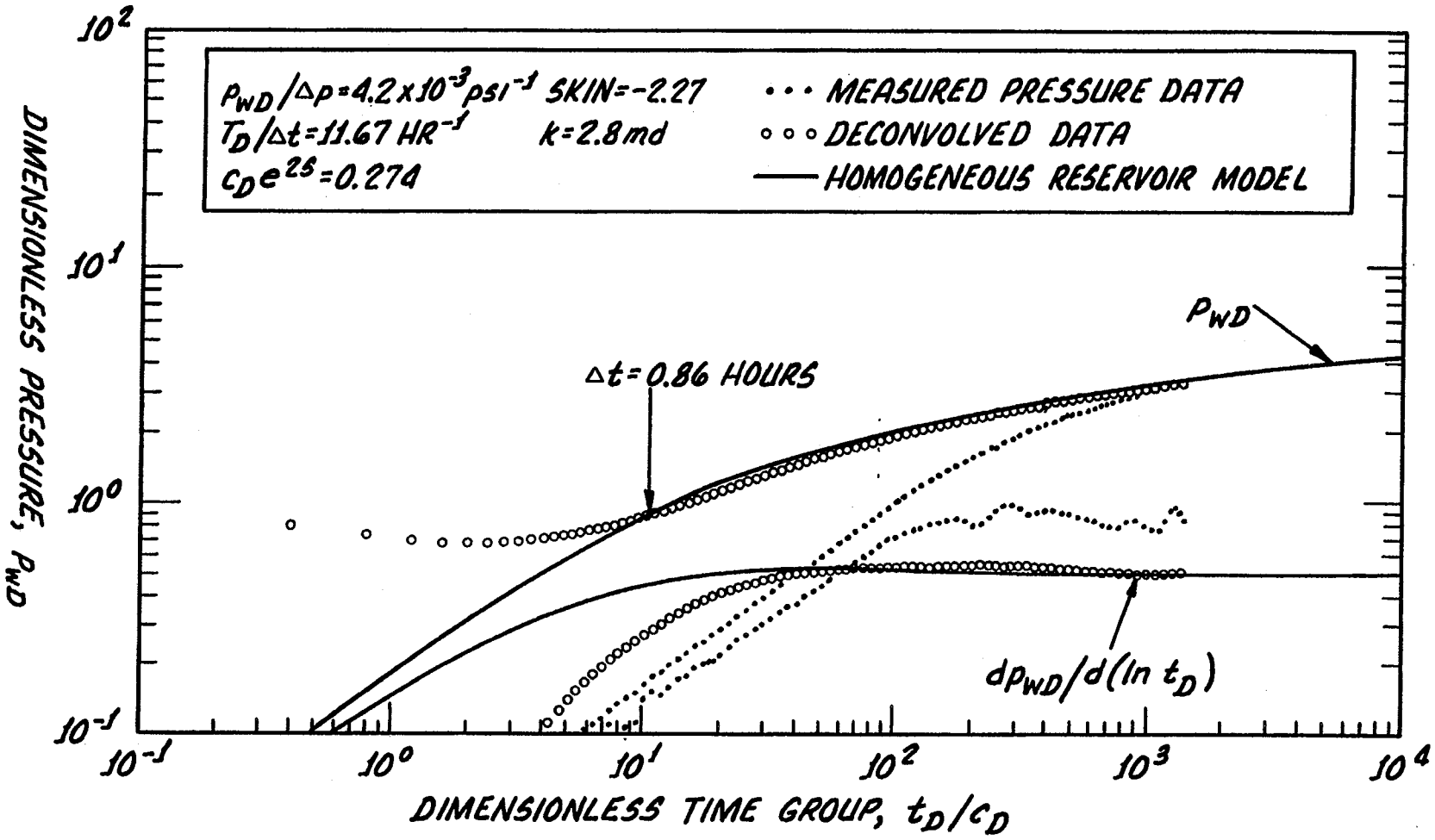
FIG. 13 Shows a graphical representation of the log of pressure change versus the log of elapsed time for Example 3 showing the variation of the pressure and the variation of the derivative of the pressure curve in dimensionless parameters.

FIG. 13 is a type curve analysis of the buildup response. Here the figure shows the measured and deconvolved pressures. It also shows the logarithmic pressure derivatives. Once again, the small squares represent the measured pressures while the large diamonds depict the deconvolved pressures. Furthermore, the solid lines represent the homogeneous reservoir type curve with $c_De^{2s}=0.274$.

In FIG. 13, the effect of deconvolution is evident. In this case, the original data before deconvolution did not reach radial flow during the test and only an approximate analysis of this data is possible. On the other hand, the curve derived from the deconvolved data exhibits radial flow for about two log cycles of shut-in time. Even if the test duration were reduced by a factor of 10 a satisfactory analysis is possible in this case. The estimated formation permeability, k, is 2.8 md and the skin factor is $-2.27$.

It has been discovered that the non-constant flow rate so often obtained from the pressure build-up tests need not be corrected or curve fit to a smooth curve. The deconvolution requires that the derivative of the sandface pressure be related to the flow rate. The inconsistencies and noise of the flow rate are echoed in, and cancelled out, by the data from the pressure rise. These inconsistencies are real data and reflect real problems or phenomenon in the formation and well bore.

Although this invention has been primarily described in conjunction with references to the preferred embodiments thereof, it is evident that many alternatives, modifications and variations will be apparent to those skilled in the art in light of the foregoing description. Accordingly, it is intended that the spirit and scope of the appended claims embrace all such alternatives, modifications and variations.

What is claimed is:

1. A method of determining production related properties of a well extending substantially downward from a surface, said well initially producing a liquid hydrocarbon at a production flowrate from a well bore and a formation, said method comprising:

shutting the well in at the surface so that the production flowrate is essentially stopped;

measuring a measured level of a gas/liquid interface rising against elapsed time within the well bore while said well is substantially shut in;

calculating a flow rate of liquid hydrocarbon into the well bore based on the measured level of the gas/-liquid interface;

solving a convolution integral using the calculated flow rate to obtain a constant sandface pressure increase;

calculating production related properties of the wellbore and of the formation adjacent the wellbore based On the solved convolution integral; and performing production well operations so that the production flowrate of liquid hydrocarbon is stimulated.

2. The method of claim 1 wherein the calculated properties include a flow rate of liquid hydrocarbon in the formation adjacent the well bore and wherein said calculating is based on a diffusivity equation.

3. The method of claim 1 wherein the level of the gas/liquid interface continues to rise one hundred hours after said shutting the well step.

4. The method of claim 1 wherein the convolution integral is solved by using a Laplace transform.

5. The method of claim 4 wherein the Laplace transform is solved by a numeric approximation method.

6. A method of determining flow properties of a well extending substantially downward from a surface, said well producing liquid hydrocarbon from a well bore and a formation comprising:

shutting the well in at the surface so that essentially no flow of the liquid hydrocarbon is produced;

measuring a measured level of a gas/liquid interface rising against elapsed time within the well bore;

calculating a flow rate of liquid hydrocarbon into the well bore based on the measured level of the gas/-liquid interface;

solving a convolution integral using the calculated flow rate to obtain a constant sandface pressure increase;

calculating flow properties of the well bore and of the formation adjacent the well bore based on the solved convolution integral; and performing well operations so that liquid hydrocarbons are more easily produced, wherein measuring the level of a gas/liquid interface rising within the well bore comprises determining the level with an echo meter.

7. The method of claim 6 which also comprises the step of measuring an increase in well bore pressure and wherein the level of the rising gas/liquid interface and an increase in well bore pressure are simultaneously measured.

8. A method for modifying the operation of a well after pressure build-up tests in a well extending from a surface to an underground formation and producing liquid hydrocarbon from substantially radial flow in said formation comprising:

shutting a well in at the surface after operation of said well, wherein said operation flows a fluid at a flowrate within said well and said flowrate is essentially stopped after shutting said well in;

measuring a level of a rising gas/liquid interface within the well;

calculating a rate of change of pressure at the underground formation based on measured levels of the rising gas/liquid interface within the well;

calculating a flow rate of liquid hydrocarbon into the well based on the calculated rate of change of pressure at the formation;

solving a Laplace-transform-based convolution integral using the calculated flow rate;

transforming the solution to the convolution integral back into real space, whereby the solution indicates flow related properties; and modifying said well operation.

9. The method of claim 8 wherein the well operation performed is abandoning the well.

10. The method of claim 8 wherein the operation performed is stimulation of the well.

11. The method of claim 8 wherein the measured level of the gas/liquid interface continues to rise after data have been collected to solve the convolution integral.

12. The method of claim 8 wherein the Laplace transform is solved by a numeric approximation method.

13. The method of claim 8 wherein the numeric Laplace transform is in the form of Eq. 1:

$$\Delta p(s) = \frac{1}{s^2}\left[\Delta p_1'(1 - e^{-s\Delta t_1}) + \sum_{i=2}^{i=n} \Delta p_i'(e^{-s\Delta t_i} - e^{-s\Delta t_{i-1}}) + \Delta p_n' e^{-s\Delta t_n}\right] \quad (1)$$

where:

s is the Laplace space variable, $\Delta\bar{p}$ is the constant rate pressure solution, $\Delta p$ is the pressure rate, $\Delta t$ is the change in time, and $\Delta p'$ is represented by Eq. 2:

$$\Delta p' = \frac{\Delta p_i - \Delta p_{i-1}}{\Delta t_i - \Delta t_{i-1}}. \quad (2)$$

14. A method for modifying the operation of a well after pressure build-up tests in wells extending from a surface to an underground formation and producing liquid hydrocarbon from substantially radial flow in said formation comprising:

substantially shutting a well in at the surface after operating said well, wherein said operating flows a liquid hydrocarbon within said well and said flow is essentially stopped after shutting said well in;

measuring a level of a rising gas/liquid interface within the well after shutting in;

calculating a rate of change of pressure within the well from measured levels of the rising gas/liquid interface;

calculating a flow rate of liquid hydrocarbon into the well based on calculated rate of change of the pressure within the wellbore;

solving a convolution integral defined by eq. 3:

$$\Delta p_w(\Delta t) + \Delta P^*(\Delta t) = \int_0^{\Delta t} \Delta q(\tau)\Delta p'(t - \tau)d\tau \quad (3)$$

where $\Delta p'$ is a time derivative of a constant sandface pressure rise;

$\Delta p_w$ is a buildup pressure rise, or equivalently, $p_{ws} - p_{wf,s}$;

$\Delta p^*$ = difference between pressure at shut-in, $p_{ws}$, and an extrapolated flowing pressure, $p_{wf}^*$, from the flow rate calculated by using a numeric Laplace transform of the form of Eq. 4:

$$\Delta p(s) = \frac{1}{s^2}\left[\Delta p_1'(1 - e^{-s\Delta t_1}) + \sum_{i=2}^{i=n} \Delta p_i'(e^{-s\Delta t_i} - e^{-s\Delta t_{i-1}}) + \Delta p_n' e^{-s\Delta t_n}\right] \quad (4)$$

where $\Delta p'$ is represented by Eq. 5:

$$\Delta p' = \frac{\Delta p_i - \Delta p_{i-1}}{\Delta t_i - \Delta t_{i-1}}; \quad (5)$$

transforming the calculated rate of change of pressure from the Laplace transform back into real space using Schapery's algorithm of the form of Eq. 6:

$$F(t) = L^{-1}f(s) = [sf(s)]_{s=\frac{1}{\gamma t}} \quad (6)$$

where $\gamma$ is an exponential of Euler's constant ($\gamma = 1.781$); and operating so that the flow of liquid hydrocarbon increases.

15. The method of claim 14 wherein said operation performed is stimulation of the well.

16. The method of claim 15 wherein the measure level of the gas/liquid interface is rising after measured level data have been collected to solve the convolution integral.

* * * * *

UNITED STATES PATENT AND TRADEMARK OFFICE

CERTIFICATE OF CORRECTION

PATENT NO. : 5,383,122

DATED : January 17, 1995

INVENTOR(S) : Charles U. Ohaeri

It is certified that error appears in the above-indentified patent and that said Letters Patent is hereby corrected as shown below:

Column 3, line 56, after "test, one" insert -- also --.

Column 7, line 50, in Eq. (7), please replace "$(\Delta-\tau)d\tau$" with -- $(\Delta t-\tau)d\tau$ --.

Column 12, line 40, replace "On" with -- on --.

Column 14, line 44, in Equation 4, replace the last term "$e^{-s\Delta tn}$" with -- $e^{-s\Delta t_n}$ --.

Signed and Sealed this

Twenty-eight Day of March, 1995

*Attest:*

*Attesting Officer*

BRUCE LEHMAN

*Commissioner of Patents and Trademarks*